US007072606B2

(12) United States Patent
Fujii et al.

(10) Patent No.: US 7,072,606 B2
(45) Date of Patent: Jul. 4, 2006

(54) ELECTROPHOTOGRAPHIC IMAGE FORMING APPARATUS EQUIPPED WITH TONER CONVEYANCE DEVICE

(75) Inventors: Ritsuo Fujii, Hachioji (JP); Seiji Yamaguchi, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 132 days.

(21) Appl. No.: 10/829,902

(22) Filed: Apr. 21, 2004

(65) Prior Publication Data

US 2005/0013634 A1 Jan. 20, 2005

(30) Foreign Application Priority Data

Jul. 15, 2003 (JP) ..... 2003-197039

(51) Int. Cl.
*G03G 15/08* (2006.01)

(52) U.S. Cl. ..... 399/258; 222/DIG. 1

(58) Field of Classification Search ..... 399/258, 399/262, 120

See application file for complete search history.

(56) References Cited

U.S. PATENT DOCUMENTS

| | | | | |
|---|---|---|---|---|
| 5,329,340 | A * | 7/1994 | Fukuchi et al. | 222/DIG. 1 X |
| 5,909,609 | A * | 6/1999 | Yahata et al. | 399/258 |
| 6,091,912 | A * | 7/2000 | Kitajima et al. | 399/258 X |
| 2003/0142999 | A1* | 7/2003 | Fujii et al. | 399/258 |
| 2004/0067076 | A1* | 4/2004 | Shinkai et al. | 399/258 |
| 2004/0105704 | A1* | 6/2004 | Yamauchi et al. | 399/258 |

FOREIGN PATENT DOCUMENTS

| | | | |
|---|---|---|---|
| JP | 2000137376 | | 5/2000 |
| JP | 2000206772 | | 7/2000 |
| JP | 2002-040777 A | * | 2/2002 |
| JP | 2003195617 | | 7/2003 |

OTHER PUBLICATIONS

European Search Report for EP04252313.4, mailed Oct. 19, 2004, 4 pgs.

* cited by examiner

*Primary Examiner*—Sophia S. Chen
(74) *Attorney, Agent, or Firm*—Squire, Sanders & Dempsey L.L.P.

(57) ABSTRACT

An electrophotographic image forming apparatus includes a toner image forming section, a recording material storing section, a sheet feeding and conveying section provided sideward of the recording material storing section, a toner reservoir section provided on a side opposite to the sheet feeding and conveying section, a toner separation section provided upward of the developing device to separate the toner, a supply pipe for interconnecting the toner reservoir section and the toner separation section to supply the toner, a collection pipe for interconnecting the toner reservoir section and the toner separation section to collect the toner, a first fluid conveyance device provided on the supply pipe between the toner reservoir section and the toner separation section for conveying a supply fluid, and a second fluid conveyance device provided on the collection pipe between the toner reservoir section and the toner separation section for conveying a collection fluid.

4 Claims, 7 Drawing Sheets

ELECTROPHOTOGRAPHIC IMAGE FORMING APPARATUS EQUIPPED WITH TONER CONVEYANCE DEVICE

BACKGROUND OF THE INVENTION

The invention relates to an electrophotographic image forming apparatus, and in particular, to a toner supply technology.

In a high-speed image forming apparatus or a color image forming apparatus, because the capacity of its toner reservoir unit for storing toner is large, there is a problem that it sometimes happens a case where it is difficult to dispose the toner reservoir unit in the neighborhood of the development device.

As regards means for solving such a problem, it has been developed a toner supply technology in which toner particles are conveyed from the toner reservoir unit to the development device by a toner conveyance method called an air conveyance method which is capable of conveying toner particles to a distant place (the publication of the unexamined patent applications H7-219329, H10-97130, H10-268641, and H10-299672).

The basic structure of a toner supply device using an air conveyance method is composed of a toner reservoir unit, a fluid conveyance means for conveying a mix fluid of toner and air from the toner reservoir unit, and a toner separation unit for separating toner particles from the conveyed mix fluid.

An electrophotographic image forming apparatus used as a copying machine or the like is generally composed of an image forming section for forming a toner image on a photoreceptor and transferring the toner image onto a recording sheet, a recording sheet accommodation section for accommodating recording sheets, and a sheet feed section for conveying a recording sheet from the recording sheet accommodation section to the image forming section, and the sheet feed section is disposed on one side of the recording sheet accommodation section.

In an image forming apparatus described in the publication of the unexamined patent applications H7-219329, H10-97130, H10-268641, and H10-299672, a toner supply section for supplying toner to be supplied to the development means of the image forming section is disposed on the same side as the sheet feed section with respect to the recording sheet accommodation section.

Because of the arrangement of the above-mentioned sheet feed section, there is little extra space at the side part of the above-mentioned recording sheet accommodation section where the above-mentioned sheet feed section is disposed; therefore, a toner reservoir unit is disposed, for example, in the upper part of the image forming apparatus. However, because the toner reservoir unit cannot be made large-sized enough, there is a problem that it is impossible to provide a toner reservoir unit having a toner accommodation capacity adapted to the high-speed performance of the image forming apparatus.

In the publication of the unexamined patent application H10-268641, a toner reservoir unit separately provided outside the image forming apparatus is disclosed. However, it is not desirable to provide a toner reservoir unit separately because it makes larger the installation area occupied by the image forming apparatus. Further, it raises a problem that it makes difficult the addition of an attachment apparatus such as a recording sheet accommodation apparatus or a finisher apparatus.

Further, in the publication of the unexamined patent application H11-212348, a toner reservoir unit is disposed sideward of sheet feed units, and so-called "Mono pump" is employed as a pump for conveying a toner. On the other hand, in the present application, two diaphragm type pumps are employed, one for supplying a toner and the other for collecting the toner. A toner separation section is disposed upward of a developing device.

In addition, in the publication of the unexamined patent application 2000-137376, a toner reservoir section is disposed upward of a sheet feeding section and on a side of sheet conveyance section, which is different in position from that of the present application.

Furthermore, in the publication of the unexamined patent application 2000-296772, a toner reservoir unit is disposed sideward of sheet feed units, and a toner is conveyed by air after the toner is conveyed by a screw from the toner reservoir unit. One pump is employed for conveying the toner. In contrast, in the present application, a toner is directly conveyed by air from a toner reservoir unit. As explained above, two pumps are employed for supplying and collecting the toner, respectively. In addition, the image forming apparatus of the present application is further provided with a toner separation section.

SUMMARY OF THE INVENTION

It is an object of the invention to solve the problem in a conventional toner supply device that its toner reservoir unit cannot be made large-sized enough.

The above-mentioned object of the invention can be accomplished by any one of the structures 1 to 8.

Structure 1: An electrophotographic image forming apparatus comprising an image forming section for forming a toner image on an image carrier and transferring the toner image formed onto a recording sheet, a recording sheet accommodation section for accommodating recording sheets, and a sheet feed section, disposed at the side part of the recording sheet accommodation section, for supplying a recording sheet from said recording sheet accommodation section to said image forming section, characterized by further comprising a toner reservoir unit, disposed at the side opposite to said sheet feed section with respect to said recording sheet accommodation section, for storing toner to be supplied to a development device of said image forming section, a toner separation unit disposed over said development device, a supply pipe connecting said toner reservoir unit and said toner separation unit, a collection pipe connecting said toner reservoir unit and said toner separation unit, a supply fluid conveyance means provided at a halfway point of said supply pipe, and a collection fluid conveyance means disposed at a halfway point of said collection pipe.

Structure 2: An electrophotographic image forming apparatus as set forth in the structure 1, characterized by the aforesaid toner reservoir unit being provided in the lower part of said electrophotographic image forming apparatus.

Structure 3: An electrophotographic image forming apparatus as set forth in the structure 1 or 2, characterized by the aforesaid supply pipe having a first vertical pipe portion extending upward from the aforesaid toner reservoir unit, and a first lateral pipe portion extending approximately horizontally and reaching the aforesaid toner separation unit, and the aforesaid supply fluid conveyance means being provided at the coupling point of said first vertical pipe portion and said first lateral pipe portion.

Structure 4: An electrophotographic image forming apparatus as set forth in any one of the structures 1 to 3, characterized by the aforesaid collection pipe having a first vertical pipe portion extending upward from the aforesaid toner reservoir unit, and a first lateral pipe portion extending approximately horizontally and reaching the aforesaid toner separation unit, and the aforesaid collection fluid conveyance means being provided at the coupling point of said first vertical pipe portion and said first lateral pipe portion.

Structure 5: An electrophotographic image forming apparatus as set forth in any one of the structures 1 to 4, characterized by the aforesaid toner reservoir unit having a toner reservoir chamber and a mixing chamber for mixing toner particles with air.

Structure 6: An electrophotographic image forming apparatus as set forth in the structure 1, 2, or 5, characterized by the aforesaid supply pipe having a second lateral pipe portion extending approximately horizontally from the aforesaid toner reservoir unit and a second vertical pipe portion extending upward and reaching the aforesaid toner separation unit, and the aforesaid supply fluid conveyance means being provided at the coupling point of said second vertical pipe portion and said second lateral pipe portion.

Structure 7: An electrophotographic image forming apparatus as set forth in the structure 1, 2, 5, or 6 characterized by the aforesaid collection pipe having a second lateral pipe portion extending approximately laterally from the aforesaid toner reservoir unit, and a second vertical pipe portion reaching the aforesaid toner separation unit, and the aforesaid collection fluid conveyance means being provided at the coupling point of said second vertical pipe portion and said second lateral pipe portion.

Structure 8: An electrophotographic image forming apparatus as set forth in the structure 1, characterized by the aforesaid supply pipe and the aforesaid collection pipe being provided at the rear side part of said electrophotographic image forming apparatus and being linearly arranged between the aforesaid toner reservoir unit and the aforesaid toner separation unit.

DETAILED DESCRIPTION OF THE PREFERRED EMBODIMENT (1) Image Forming Apparatus

Figure 1:
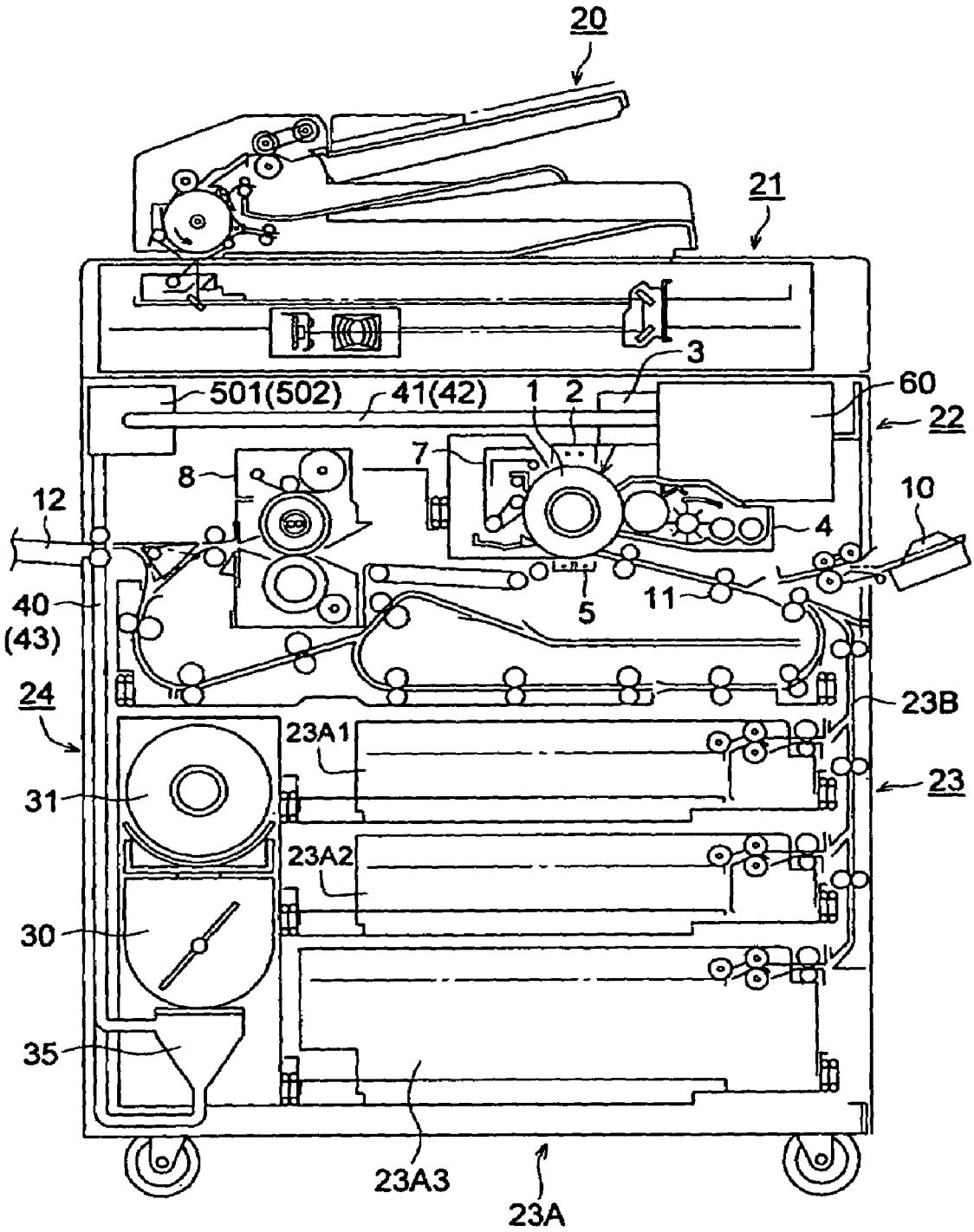
FIG. 1 is a drawing showing an image forming apparatus of the embodiment of the invention.

FIG. 1 is a drawing showing an example of an image forming apparatus of the embodiment of the invention.

The image forming apparatus is equipped with an automatic document feeder 20, a document reading section 21, an image forming section 22, a fixing device 8, and a sheet feed section.

In FIG. 1, in the automatic document feeder 20, document sheets placed on its document feed table are fed one by one to a reading position, and the document sheets after being read are accumulated on a document output tray.

The document reading section 21 reads an image on a document sheet, to generate digital image data.

The image forming section 22 forms an image on a recording sheet by an electrophotographic method; in the image forming section 22, there are arranged around a drum-shaped photoreceptor 1 as an image carrier, a charging device 2, an exposure device 3, a development device 4, a transfer device 5, and a cleaning device 7. Under the image forming section 22, there is provided a sheet feed section 23 equipped with plural recording sheet accommodation units and plural sheet conveyance units, to feed a recording sheet to the image forming section 22. The numeral 10 denotes a manual sheet feed unit. A recording sheet fed from the sheet feed section 23 or the manual sheet feed unit 10 is supplied into the gap between the photoreceptor 1 and the transfer device 5 by a pair of registration rollers 11, and is subjected to fixing processing by the fixing device 8, to be ejected onto an output tray 12.

The sheet feed section 23 is composed of a recording sheet accommodation unit 23A having three units of sheet feed trays 23A1, 23A2, and 23A3, and a sheet conveyance unit 23B arranged in the side space of the recording sheet accommodation unit 23A.

The photoreceptor 1 rotates clockwise, and through charging by the charging device 2, exposure by the exposure device 3, and development by the development device 4, a toner image is formed on the photoreceptor 1. The toner image formed is transferred onto a recording sheet by the transfer device 5. The recording sheet having the toner image transferred thereon is subjected to fixing processing in the fixing device 8, and then it is ejected onto the output tray 12.

In a color image forming apparatus, there are provided an image forming section for forming a yellow image, an image forming section for forming a magenta image, an image forming section for forming a cyan image, and an image forming section for forming a black image, and each of the image forming sections has a development device.

Further, as regards a transfer device for transferring a toner image formed on the image carrier onto a recording sheet, it is also possible to use a transfer device which includes a primary transfer means, an intermediate transfer member, and a secondary transfer means, transfers the toner image formed on the image carrier by means of the above-mentioned primary transfer means onto the intermediate transfer member, and transfers the toner image on the intermediate transfer member onto a recording sheet by the above-mentioned secondary transfer means.

The development device 4 develops an electrostatic latent image on the photoreceptor 1 with a two-component developer containing a toner and a carrier or a single-component developer not containing a carrier but containing a toner and an additive. In the development device 4, developer of a specified amount is contained, and in a case where a two-component developer is used, the toner, having been consumed by development, is replenished from a toner reservoir unit 24 to be explained next, which maintains the toner concentration of the developer in the development device at a specified value all the time. Further, in a development device using a single component developer, the amount of developer in the development device is maintained at a specified value by similar toner replenishment.

The toner reservoir unit 24 is fitted with a toner container 31. The toner reservoir unit has a toner hopper 30 as an example of a toner storage chamber and a funnel-shaped mixing chamber 35, and a toner separation unit 60 disposed in the neighborhood of the development device 4 is coupled with the toner reservoir unit 24 which is provided at a distant position from the development device 4 by the supply pipes 40 and 41, and the collection pipes 42 and 43.

(2) Toner Supply Device

Figure 2:
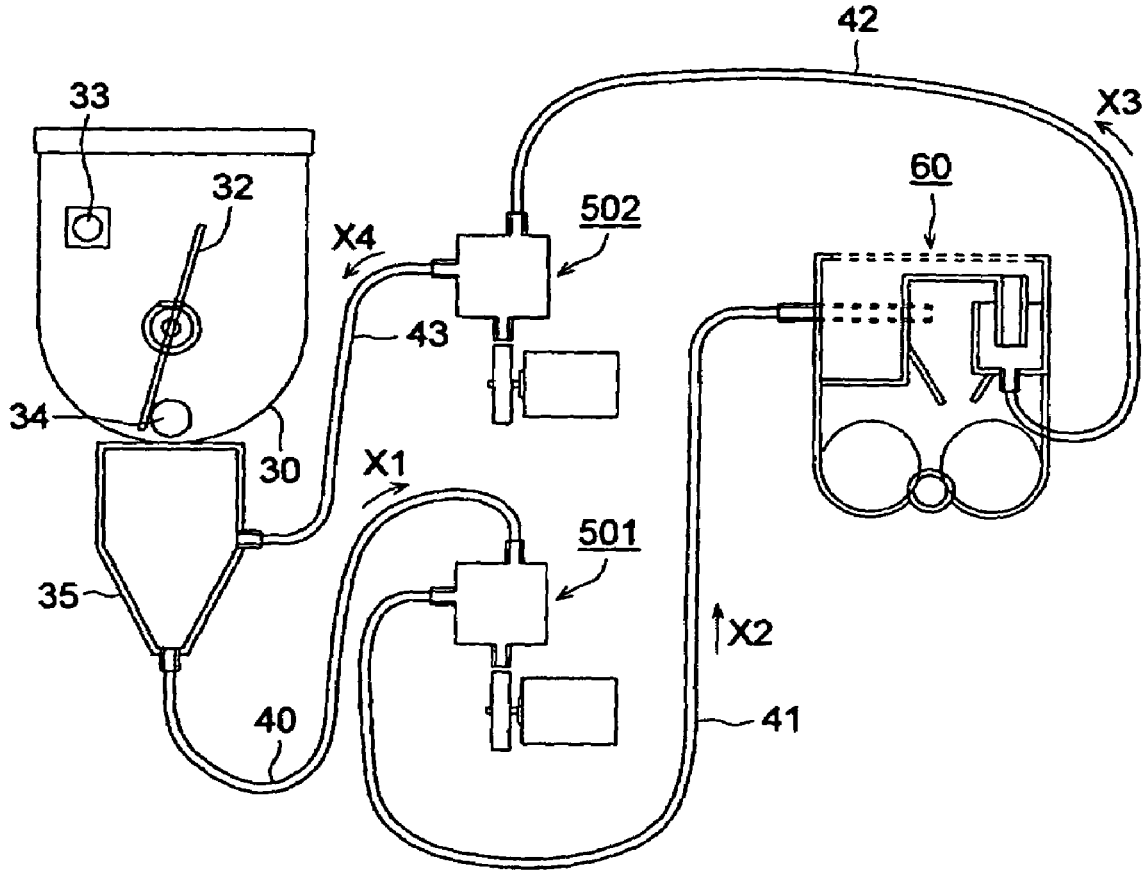
FIG. 2 is a drawing showing a toner supply device of the embodiment of the invention.
Figure 3:
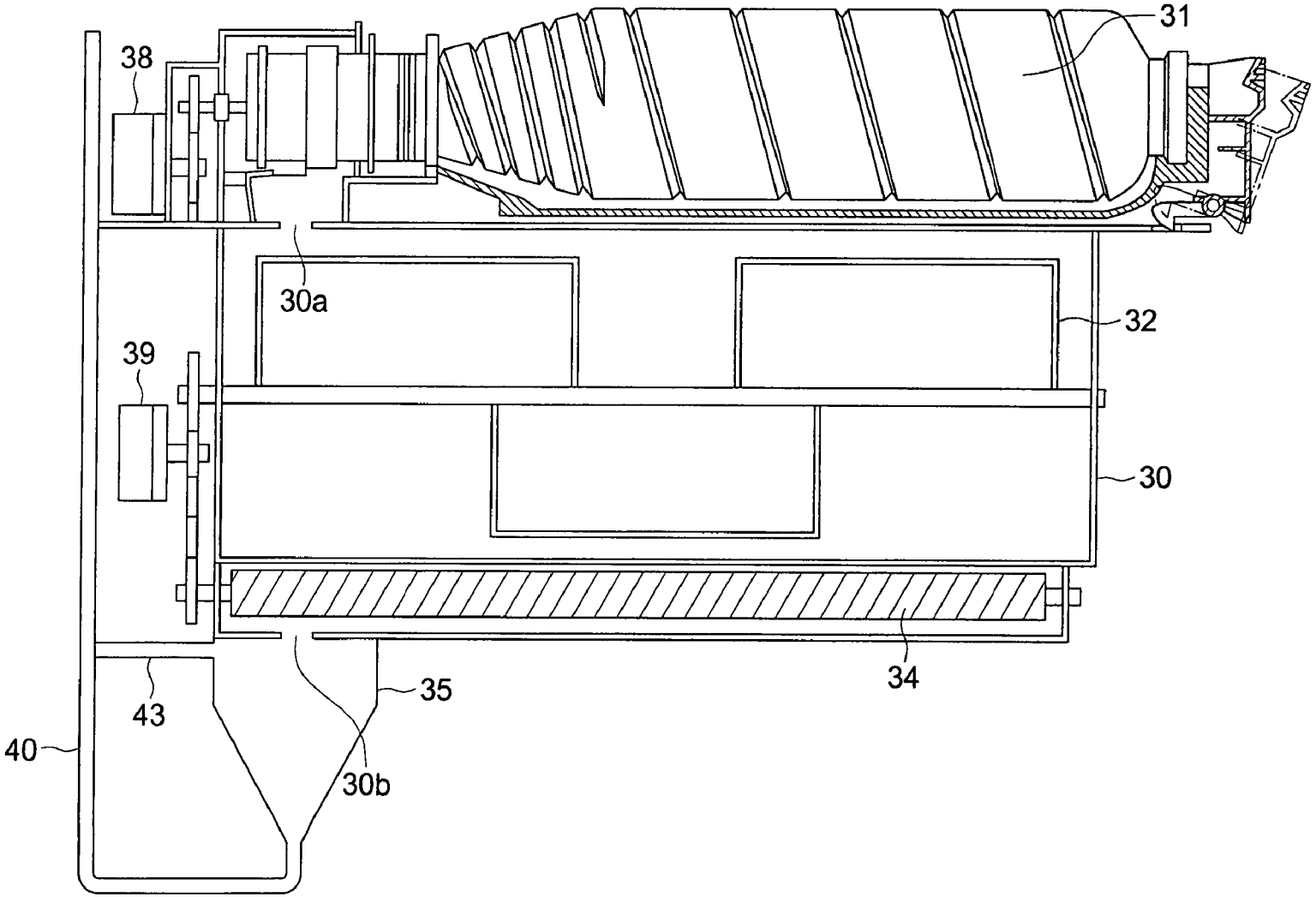
FIG. 3 is a drawing showing a toner reservoir unit.

FIG. 2 shows a toner supply device of the image forming apparatus of the embodiment of the invention shown in FIG. 1, and FIG. 3 shows a toner reservoir unit.

The toner supply device is composed of the toner reservoir unit 24 (composed of the toner container 31, toner hopper 30, and the mixing chamber 35), a pump 501 as a supply fluid conveyance means, a pump 502 as a collection fluid conveyance means, the toner separation unit 60, the supply pipes 40 and 41, and the collection pipes 42 and 43. Each of the pumps 501 and 502 are disposed at each of the coupling points of supply pipe 40 and the collection pipe 43 as the first vertical pipe portions extending upward from the toner reservoir unit 24 to the supply pipe 41 and the collection pipe 42 respectively as the first lateral pipe portions arranged approximately horizontally. The first vertical pipe portions are arranged approximately vertically, and the first lateral pipe portions are arranged approximately horizontally. The supply pipe 40 couples the toner reservoir unit 24 and the pump 501, and the collection pipe 43 couples the toner reservoir unit 24 and the pump 502. Further, the supply pipe 41 couples the pump 501 and the toner separation unit 60, and the collection pipe 42 couples the pump 502 and the toner separation unit 60. That is, the pumps 501 and 502 each are disposed at the coupling point of the first vertical pipe portions and the first lateral pipe portions.

(3) Toner Reservoir Unit

The toner reservoir unit 24 is basically composed of a toner storage chamber and a mixing chamber for mixing toner particles with air.

In an example shown in the drawing, the toner storage chamber is composed of the toner container 31 and the toner hopper 30, but it is also possible to make it have a structure not having the toner container 31. That is, it is also appropriate that the toner storage chamber is made up of a toner hopper only, and toner particles are introduced from a toner container, a toner sack, or the like into the toner hopper.

The toner reservoir unit 24 is disposed in the side part opposite to the side part where the sheet conveying unit 23B is disposed with respect to the recording sheet accommodation unit 23A.

By this arrangement, it is possible to dispose the toner reservoir unit without giving an influence to the arrangement of other sections, and also it is possible to make the capacity of the toner reservoir unit sufficiently large. Further, also it is possible to dispose toner reservoir units of color toners.

The toner reservoir unit 24 has the toner hopper 30 and the funnel-shaped mixing chamber 35. The toner reservoir unit 24 is fitted with the cylindrical toner container 31, and by the rotational driving of the toner container 31 by a motor 38, toner particles drop down from the toner container 31 through an opening 30*a* into the toner hopper 30. In the toner hopper 30, there are provided a stirring member 32 having a plurality of U-shaped portions formed therein and a conveyance screw 34 located at the lower part.

By the rotation of the stirring member 32 and the conveyance screw 34 actuated by the rotation of the motor 39, toner particles drop down from the toner hopper 30 through an opening 30*b* into the mixing chamber 35.

Because air is introduced into the mixing chamber 35 through the collection pipe 43 as will be explained later, a fluid composed of toner particles and air mixed together is formed.

Figure 4:
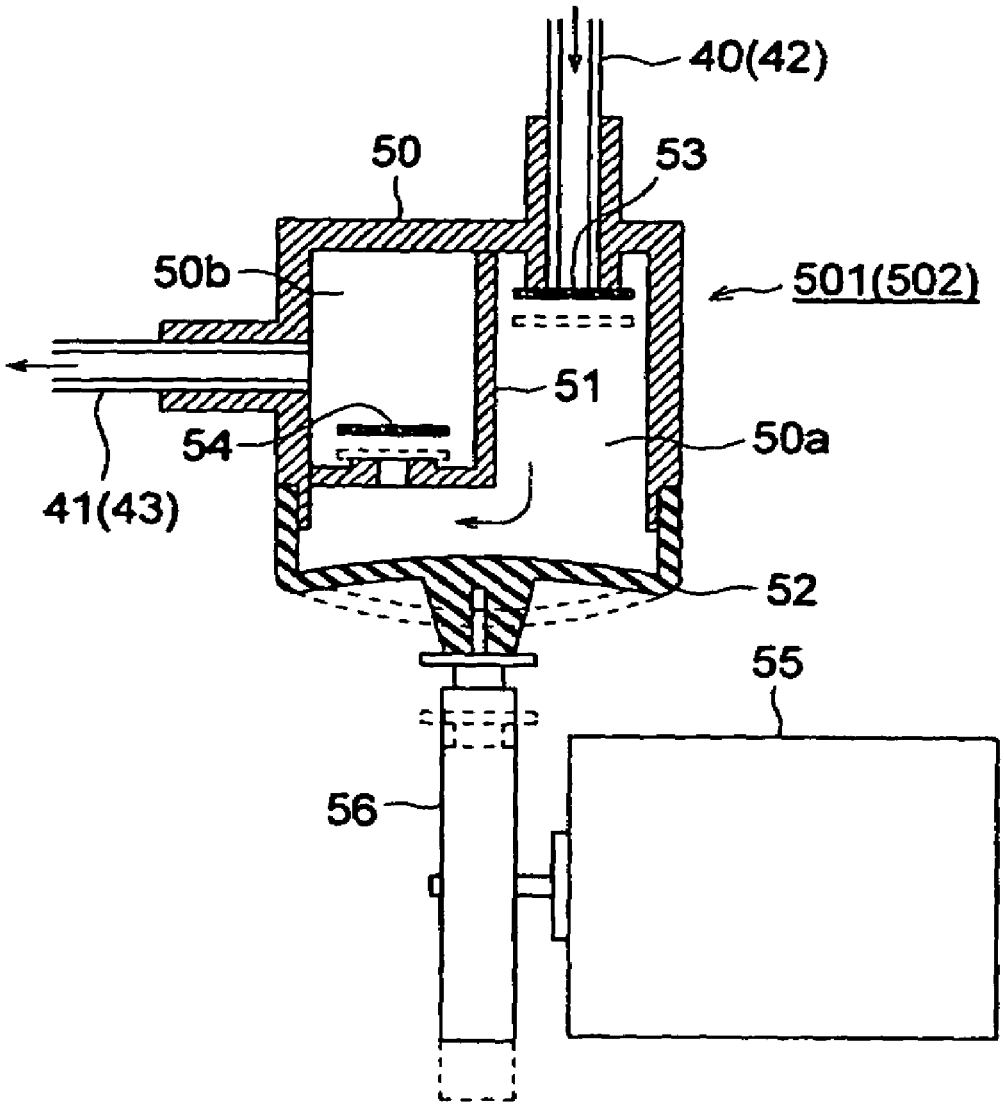
FIG. 4 is a drawing showing a pump.

For the fluid conveyance means, the pumps 501 and 502 each made up of a diaphragm pump shown in FIG. 4 are used; however, it is possible to use an arbitrary pump known to the public such as a screw pump disclosed in the publication of the unexamined patent applications H7-219329 and H8-6368. The pump 501 makes up a supply fluid conveyance means for conveying a mix fluid of toner particles and air from the toner reservoir unit 24 to the toner separation unit 60, and the pump 502 makes up a collection fluid conveyance means for collecting air from the toner separation unit 60 to the toner reservoir unit 24. Further, in the example shown in the drawing, the pumps 501 and 502 having the same structure are used, but also it is appropriate to use pumps having different structures or of different kinds for the supply fluid conveyance means and for the collection fluid conveyance means.

(4) Fluid Conveyance Means

In the example shown in the drawing, the fluid conveyance means are disposed over the toner reservoir unit.

By such an arrangement of the fluid conveyance means, it is possible to make the supply pipe and the collection pipe linear by the disposing of the fluid conveyance means at a halfway point of the supply pipe and the collection pipe, and the conveyance system of the fluid is prevented from clogging up, while in a case where clogging up occurs, it can be easily removed.

The pumps 501 and 502 will be explained with reference to FIG. 4. The pumps 501 and 502 each are made up of a diaphragm pump having the same structure shown in FIG. 4.

The suction opening of the pump 501 is connected to the supply pipe 40, and its exhaust opening is connected to the supply pipe 41. The suction opening of the pump 502 is connected to the collection pipe 42, and its exhaust opening is connected to the collection pipe 43. The pump chamber formed of an outer wall 50 is partitioned into a suction chamber 50*a* and a exhaust chamber 50*b* by an inner wall; a valve 53 is provided at the suction opening of the suction chamber 50*a*, and a valve 54 is provided at the vent (the vent provided in the inner wall 51) of the exhaust chamber 50*b*.

A part of the outer shell of each of the pumps 501 and 502 is formed of a diaphragm 52 made of an elastomer of a rubber, and the diaphragm 52 is driven by an eccentric rotary member 56 driven by a motor 55, to make a deformation between the state shown by the solid line and the state shown by the dotted line.

The eccentric rotary member 52 is rotated by the motor 55, and the diaphragm 52 is deformed by this rotation between the state shown by the solid line and the state shown by the dotted line, to vary the volume of suction chamber 50*a* to increase and decrease the pressure in the suction chamber 50*a*. By this increase and decrease of the pressure, the valves 53 and 54 are transferred between the state shown by the solid line and the state shown by the broken line, to convey a fluid in one direction as shown by the arrow mark.

(5) Toner Separation Unit

The toner separation unit 60 is a portion that separates toner particles from the fluid, and supplies the toner particles to the development device, and by making the separated toner particles drop into the development device, the toner supply mechanism can be simplified. Accordingly, the toner separation unit is disposed over the development device.

Figure 5:
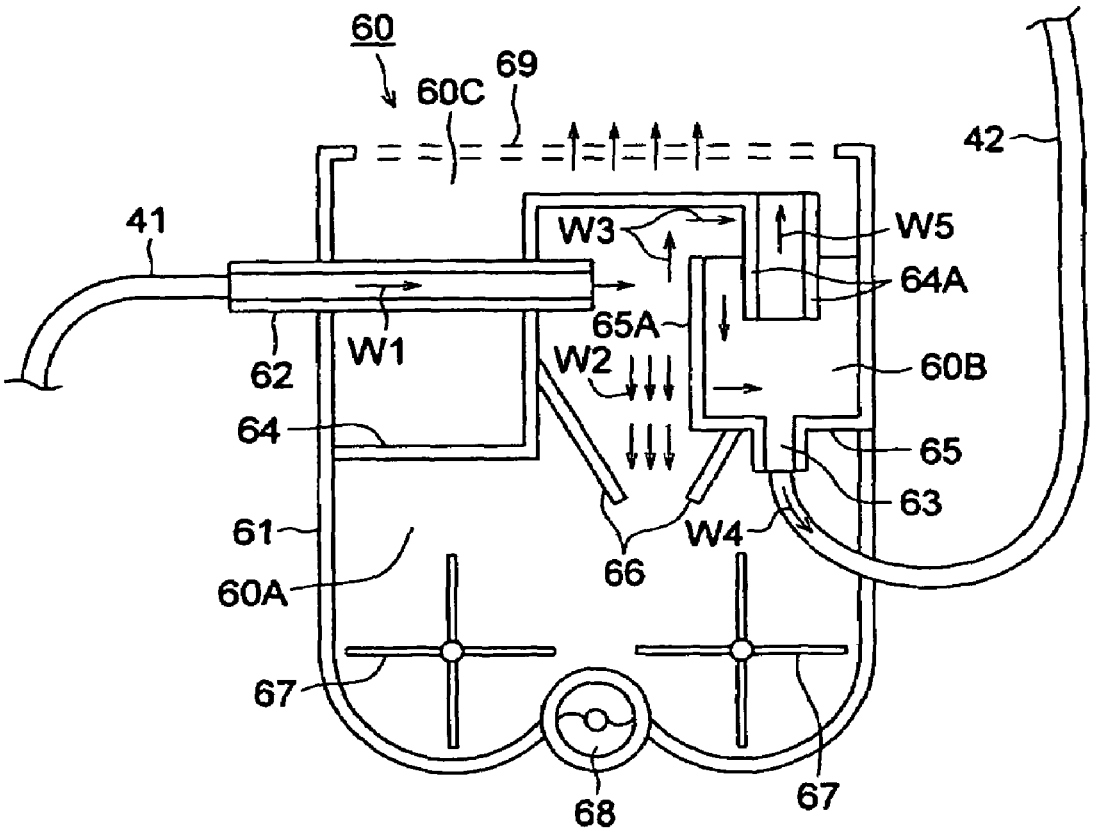
FIG. 5 is a drawing showing a toner separation unit.

Next, the toner separation unit will be explained with reference to FIG. 5.

The toner separation unit has an outer wall 61 making up the outer shell of the toner separation unit 60, inner walls 64 and 65, and an auxiliary wall 66 for separating the inside of the toner separation unit 60 into an introduction chamber 60A and an exhaust chamber. The exhaust chamber is composed of an exhaust portion 60B and a filter chamber 60C.

An air inlet 62 is provided in the introduction chamber 60A, and an air outlet 63 is provided in the exhaust portion 60B. The auxiliary inner wall 66 guides toner particles dropping down, and also suppresses toner particles rising upward. In the lower part of the toner separation unit 60, there are provided a stirring member 67 having blades and a screw 68 for conveying toner particles in the axial direction. A mix fluid of toner particles and air is introduced from the air inlet 62 into the introduction chamber 60A as shown by the arrow mark W1, and the toner particles drop down as shown by the arrow mark W2. The introduction chamber 60A is filled with the mix fluid, which is subject to the pressure due to the fluid conveyance force by the pump 502, and a part of it rises upward to be conveyed to the exhaust portion 60B as shown by the arrow mark W3. By the effect of the specific weight of toner particles and the auxiliary wall 66, the toner concentration in the mix fluid rising upward in the direction shown by the arrow mark W3 is made low, and the fluid comes to be approximately composed of air only. The mix fluid in the exhaust portion 60B is discharged from the air outlet 63 as shown by the arrow mark W4, while a part of it enters the filter chamber 60C as shown by the arrow mark W5, and is filtrated by the filter 69 to be discharged.

As shown in the drawing, a connection passage for making the fluid meander is formed by the vertical part 65A of the inner wall 65 and the vertical part 64A of the inner wall 64. By such a connection passage, the toner content in the discharged air and the toner content in the fluid processed by the filter 69 is made to have a low value. The vertical part 65A and the vertical part 64A are cylindrical, and have a structure such that the cylinder of the vertical part 64A is placed in the cylinder of the vertical part 65A.

(Operation of Toner Supply)

As shown in FIG. 2, the toner hopper 30 and the pumps 501 and 502, as well as the toner separation unit 60 are coupled by the supply pipes 40, 41 and the collection pipes 42, 43.

Toner supply is carried out through a process such that, by the pump 501, a mix fluid is conveyed from the toner hopper 30 to the pump 501 as shown by the arrow mark X1 and from the pump 501 to the toner separation unit 60 as shown by the arrow mark X2, and by the pump 502, the air is collected from the toner separation unit 60 to the pump 502 as shown by the arrow mark X3 and from the pump 502 to the toner hopper 30 as shown by the arrow mark X4. Further, toner particles are separated in the toner separation unit 60, and are supplied to the development device 4 by the screw 68.

The amount of toner in the toner hopper 30 are detected by a toner sensor 33 using a piezoelectric element, and when the level of the pile of toner particles becomes lower than the level capable of detection by the toner sensor 33, the motor 38 is actuated to supply toner from the container 31 to the toner hopper 30.

By a supply signal for supplying toner to the development device 4 transmitted from a control means not shown in the drawing, the motor 39 shown in FIG. 3 is actuated to drive the stirring member 32 to stir toner particles in the hopper 30 and also the screw 34 to make the toner particles drop down into the mixing chamber 35. By the above-mentioned supply signal, the motor 55 is actuated to operate the pumps 501 and 502. By the operation of the pumps 501 and 502, an air flow is generated in the mixing chamber 35 to mix toner particles with air, and the mix fluid is conveyed through the supply pipes 40 and 41 to the toner separation unit 60 by the conveyance force of the pump 501.

The toner particles separated in the toner separation unit 60 are supplied to the development device 4 by the screw 68. Further, the separated air is collected through the collection pipes 42 and 43 to the mixing chamber 35 by the conveyance force of the pump 502.

(7) Another Example of Embodiment

Figure 6:
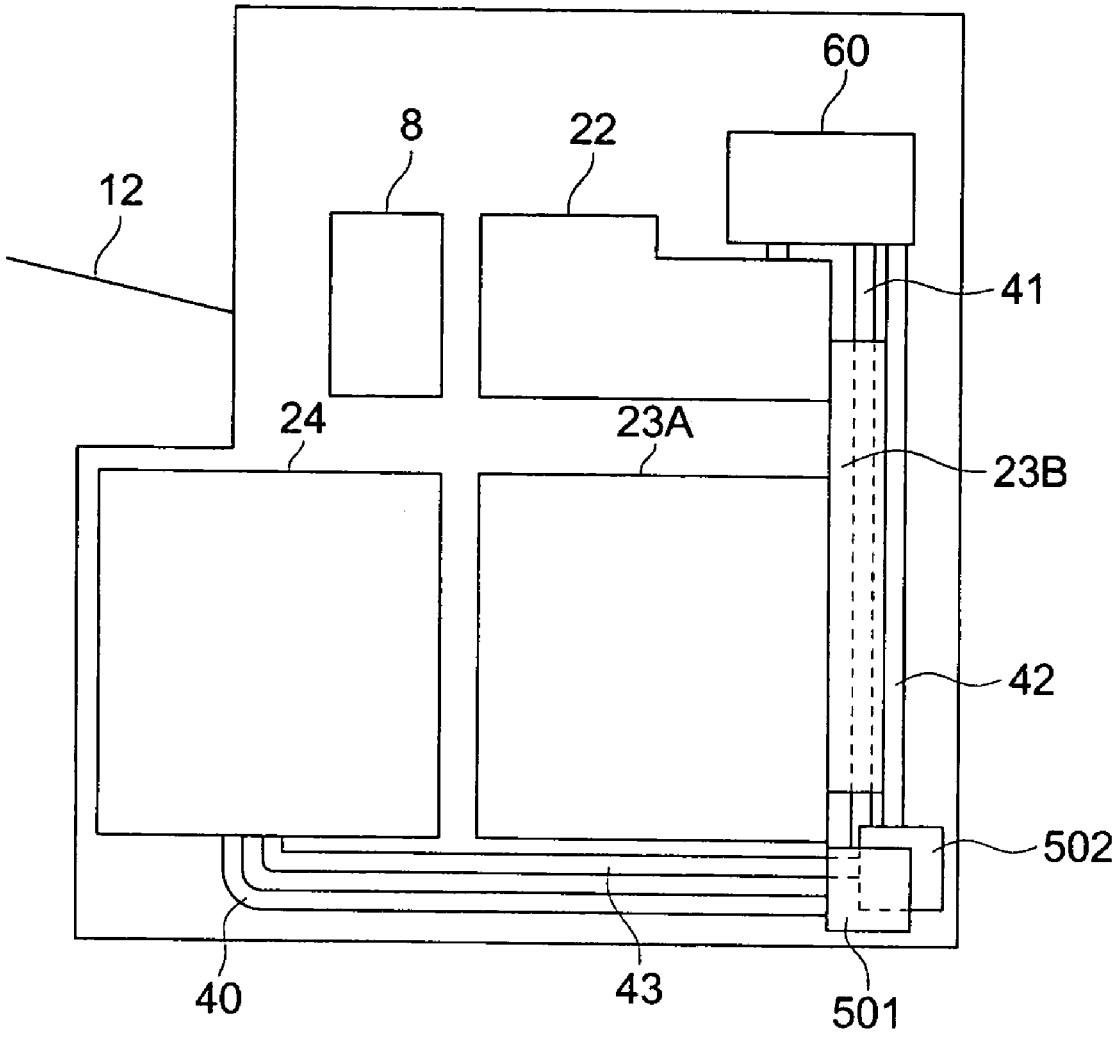
FIG. 6 is a drawing showing another example of an image forming apparatus of the embodiment of the invention.

FIG. 6 is a drawing showing another example of an image forming apparatus of the embodiment of the invention.

In this example, the pump 501 as a supply fluid conveyance means and the pump 502 as a collection fluid conveyance means are disposed under the sheet conveyance unit 23B. Besides, the toner reservoir unit 24 is disposed in the side part of the recording sheet accommodation unit 23A and under the fixing device 8, that is, in the side part opposite to the sheet conveyance unit 23B with respect to the sheet accommodation unit 23A.

The supply pipe 40 as the second lateral pipe portion and the collection pipe 43 as the second lateral pipe portion coupling the toner reservoir unit 24 to the pumps 501 and 502 respectively are disposed at the bottom part of the apparatus; the supply pipe 40 arranged approximately horizontally is coupled to the pump 501, and the collection pipe 43 arranged approximately horizontally is coupled to the pump 502.

The supply pipe 41 as the second vertical pipe portion and the collection pipe 42 as the second vertical pipe portion coupling the pumps 501 and 502 respectively to the toner separation unit 60 are disposed in the rear side part of the sheet conveyance unit 23B, that is, in the deep side part of the apparatus.

The supply pipe 41 couples the pump 501 to the toner separation unit 60, and is arranged approximately vertically. The collection pipe 42 couples the pump 502 to the toner separation unit 60, and is arranged approximately vertically.

Figure 7:
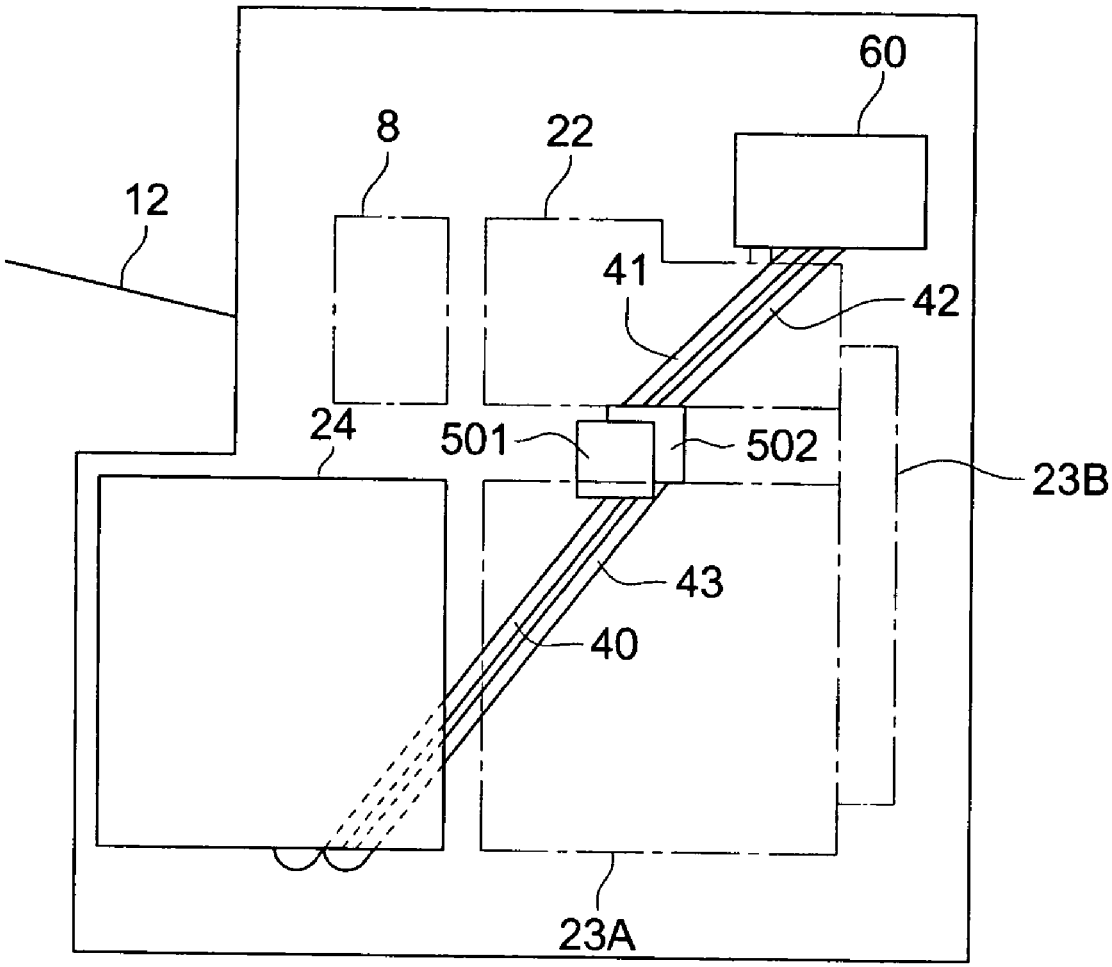
FIG. 7 is a drawing showing another example of an image forming apparatus of the embodiment of the invention.

FIG. 7 is another example of an image forming apparatus of the embodiment of the invention. In FIG. 7, the portions shown by the alternate long and short dash lines show that they are disposed at this side of the supply pipes 40 and 41, and the collection pipes 42 and 43 shown by the solid lines.

As shown in the drawing, the supply pipe 40 and the collection pipe 43 are disposed in the rear side part of the apparatus, that is, in the deep side part of the apparatus, extend obliquely upward from the toner reservoir unit 24, and are coupled to the pumps 501 and 502 disposed at the middle position respectively. The supply pipe 41 and the collection pipe 42 extend obliquely upward from the pumps 501 and 502 respectively, and are coupled to the toner separation unit 60.

As clearly understood from the drawing, the supply pipes 40 and 41, and the collection pipes 42 and 43 are formed linearly.

In addition, in the example shown in FIG. 6 and FIG. 7, by making the toner reservoir unit protrude to the side direction under the output tray 12, the volume of the toner reservoir unit is made larger.

By any one of the structures 1 to 8, it is possible to arrange a toner reservoir unit having a large volume, in a high-speed image forming apparatus or a color image forming apparatus, it is possible to store toner of a sufficient amount in the apparatus.

By the structure 3 or 6, it is possible to make linear the supply pipes for transporting toner from the toner reservoir unit to the toner separation unit. Therefore, it is possible to prevent the toner transport system from clogging up.

By the structure 4 or 7, it is possible to make linear the collection pipes for collecting air from the toner separation unit to the toner reservoir unit. Therefore, it is possible to prevent the toner transport system from clogging up.

By the structure 8, it is possible to make linear the supply pipes for supplying toner from the toner reservoir unit to the toner separation unit and the collection pipes for collecting air from the toner separation unit to the toner reservoir unit. Therefore, it is possible to prevent the toner transport system from clogging up.

What is claimed is:

1. An electrophotographic image forming apparatus comprising:

(a) an image forming section for forming a toner image on an image carrier and transferring the formed toner image onto a recording material;

(b) a recording material storing section for storing recording materials;

(c) a sheet feeding and conveying section provided sideward of the recording material storing section for supplying a recording material from the recording material storing section to the image forming section;

(d) a toner reservoir section provided on a side opposite to the sheet feeding and conveying section with respect to the recording material storing section, for storing toner to be supplied to a developing device of the image forming section;

(e) a toner separation section provided upward of the developing device to separate the toner;

(f) a supply pipe for interconnecting the toner reservoir section and the toner separation section to supply the toner;

(g) a collection pipe for interconnecting the toner reservoir section and the toner separation section to collect the toner;

(h) a first fluid conveyance device provided on the supply pipe between the toner reservoir section and the toner separation section for conveying a supply fluid; and (i) a second fluid conveyance device provided on the collection pipe between the toner reservoir section and the toner separation section for conveying a collection fluid, wherein the supply pipe comprises a first vertical pipe section extending upward from the toner reservoir section and a first horizontal pipe section extending horizontally to reach the toner separation section, and the first fluid conveyance device is provided at a coupling point of the first vertical pipe section and the first horizontal pipe section.

2. The electrophotographic image forming apparatus of claim 1, wherein the collection pipe comprises a first vertical pipe section extending upward from the toner reservoir section and a first horizontal pipe section extending horizontally to reach the toner separation section, and the second fluid conveyance device is provided at a coupling point of the first vertical pipe section and the first horizontal pipe section.

3. An electrophotographic image forming apparatus comprising:

(a) an image forming section for forming a toner image on an image carrier and transferring the formed toner image onto a recording material;

(b) a recording material storing section for storing recording materials;

(c) a sheet feeding and conveying section provided sideward of the recording material storing section for supplying a recording material from the recording material storing section to the image forming section;

(d) a toner reservoir section provided on a side opposite to the sheet feeding and conveying section with respect to the recording material storing section, for storing toner to be supplied to a developing device of the image forming section;

(e) a toner separation section provided upward of the developing device to separate the toner;

(f) a supply pipe for interconnecting the toner reservoir section and the toner separation section to supply the toner;

(g) a collection pipe for interconnecting the toner reservoir section and the toner separation section to collect the toner;

(h) a first fluid conveyance device provided on the supply pipe between the toner reservoir section and the toner separation section for conveying a supply fluid; and (i) a second fluid conveyance device provided on the collection pipe between the toner reservoir section and the toner separation section for conveying a collection fluid, wherein the supply pipe and the collection pipe are provided on a rear side of the apparatus, and between the toner reservoir section and the toner separation section in a straight line.

4. An electrophotographic image forming apparatus comprising:

(a) an image forming section for forming a toner image on an image carrier and transferring the formed toner image onto a recording material;

(b) a recording material storing section for storing recording materials;

(c) a sheet feeding and conveying section provided sideward of the recording material storing section for supplying a recording material from the recording material storing section to the image forming section;

(d) a toner reservoir section provided on a side opposite to the sheet feeding and conveying section with respect to the recording material storing section, for storing toner to be supplied to a developing device of the image forming section;

(e) a toner separation section provided upward of the developing device to separate the toner;

(f) a supply pipe for interconnecting the toner reservoir section and the toner separation section to supply the toner;

(g) a collection pipe for interconnecting the toner reservoir section and the toner separation section to collect the toner;

(h) a first fluid conveyance device provided on the supply pipe between the toner reservoir section and the toner separation section for conveying a supply fluid; and (i) a second fluid conveyance device provided on the collection pipe between the toner reservoir section and the toner separation section for conveying a collection fluid, wherein the collection pipe comprises a first vertical pipe section extending upward from the toner reservoir section and a first horizontal pipe section extending horizontally to reach the toner separation section, and the second fluid conveyance device is provided at a coupling point of the first vertical pipe section and the first horizontal pipe section.

* * * * *